US005170923A

United States Patent [19]

Dear et al.

[11] Patent Number: 5,170,923

[45] Date of Patent: Dec. 15, 1992

[54] NOSEPIECE FOR INSTALLATION OF BLIND TUBULAR RIVETS

[75] Inventors: Aiden R. Dear, Stotfold; Terence Gilbert, Welwyn Garden City, both of England

[73] Assignee: Avdel Systems Limited, Welwyn Garden City, England

[21] Appl. No.: 771,180

[22] Filed: Oct. 4, 1991

[30] Foreign Application Priority Data

Oct. 5, 1990 [GB] United Kingdom ..... 9021751

[51] Int. Cl.[5] ..... B21J 15/34

[52] U.S. Cl. ..... 227/55; 227/62; 29/243.521; 29/243.522; 29/812.5; 72/391.6

[58] Field of Search ..... 227/51, 52, 53, 55, 227/60, 61, 62; 29/243.519, 243.521, 243.522, 243.523, 243.524, 243.525, 243.526, 243.527, 243.528, 243.529, 243.54, 812.5; 72/391.4, 391.6

[56] References Cited

U.S. PATENT DOCUMENTS

| | | | |
|---|---|---|---|
| 2,340,066 | 1/1944 | Lee | 72/391.6 |
| 3,005,566 | 10/1961 | Neighorn et al. | 29/812.5 |
| 4,220,033 | 9/1980 | Powderley | 72/391.6 |

FOREIGN PATENT DOCUMENTS

| | | | |
|---|---|---|---|
| 0113538 | 7/1941 | Australia | 72/391.6 |
| 1183049 | 3/1970 | United Kingdom . | |
| 1572269 | 7/1980 | United Kingdom . | |
| 2124955 | 2/1984 | United Kingdom . | |

*Primary Examiner*—Frank T. Yost
*Assistant Examiner*—Raymond D. Woods
*Attorney, Agent, or Firm*—Oblon, Spivak, McClelland, Maier & Neustadt

[57] ABSTRACT

A nosepiece assembly for a blind pull-through riveting tool has long nosepiece jaws (11*a*, 11*a*) for access into deep, narrow cavities. The inside of the nosepiece assembly is provided with a device for locking the jaws together at least when a rivet is being installed. The locking device includes a frusto-conical locking face (35) on the front end of a tube (34) fixed to the tool barrel (18), co-operating with two half frusto-conical faces on the inside of the jaws. The locking faces are normally urged out of engagement by the spring (20) and are urged into locking engagement by the rearwards axial force exerted on the jaw anvil (25) by the head (33) of the rivet being installed. In a modification, the spring (20) normally urges the locking faces (35, 36) into engagement, and they are urged out of engagement by the next rivet being fed forwardly through the anvil parts (13, 13).

12 Claims, 3 Drawing Sheets

NOSEPIECE FOR INSTALLATION OF BLIND TUBULAR RIVETS

Figure 1:
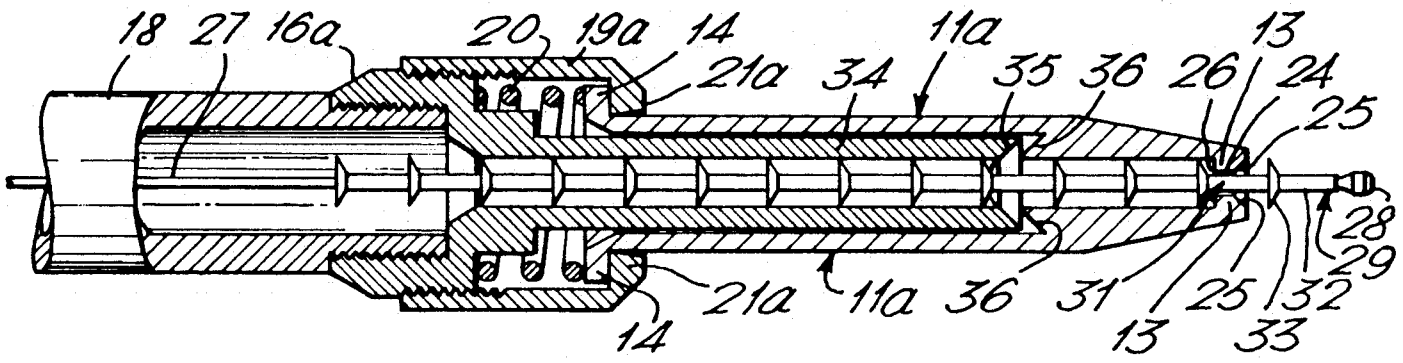

A blind rivet is one which can be installed in a workpiece by access to the one side only of the workpiece, and blind installation is installation by access to one side only of the workpiece. One common variety of blind rivet is the so-called pull-through variety of blind tubular rivet, which essentially comprises a tubular body with a bore extending completely through it, and a preformed head at one end. In use, the rivet is inserted in a hole in a workpiece in which the outside of the rivet is a fairly close radial fit, with the preformed head in contact with the nearer face of the workpiece. It is installed by pulling through the bore the head of a mandrel, the mandrel head having a greater external diameter than at least part of the bore (the term "diameter" is used because the rivet bore and the mandrel head are usually both circular in cross-section, although not necessarily so). The passage of the mandrel head through the bore thus radially expands at least part of the bore and the corresponding part of the exterior of the tubular rivet, thereby deforming the rivet into engagement with the workpiece in which it is inserted. The remote end of the rivet usually protrudes from the rear face of the workpiece and is expanded to form a blind head. The mandrel is removed completely from the rivet bore and forms no part of the installed rivet, but is re-used to install further rivets. Examples of such rivets are the blind tubular rivets commercially available in many countries of the world under the Registered Trade Marks CHOBERT, BRIV and AVLUG.

When the head of the mandrel is pulled through a rivet, the rivet must be supported axially against the axial force exerted on it by the mandrel head. This is done by means of an annular anvil, the annular face of which contacts the preformed head of the tubular rivet, the mandrel stem extending through the aperture in the center of the anvil.

The practice is for a column of tubular rivets to be loaded onto the mandrel, behind the anvil. The anvil is provided at the front end of a tubular nosepiece through which the mandrel extends. In order to feed the next rivet along the mandrel stem and forwardly through the anvil to the front of the anvil, the tubular nosepiece is split longitudinally into two parts along a plane containing the mandrel axis. These two parts are referred to as "jaws", since their shape and movement resemble those of a pair of jaws, although these parts do not usually perform any gripping operation. The anvil surface thus comprises two parts, one at the front end of each jaw. When the mandrel head has been withdrawn through the anvil aperture, the column of fasteners on the mandrel stem is urged forwards so that the leading rivet contacts the mandrel head. The mandrel head and the leading rivet are urged forwards so that they force the anvil parts apart and allow the leading rivet through the thus enlarged anvil aperture. The anvil parts then close behind the head of the leading rivet and around the shank of the next succeeding rivet, in the axial space behind that head and in front of the head of the next succeeding rivet, ready to provide axial support to the leading rivet when it is placed.

The jaws are normally spring-urged together, so that the anvil parts can be pushed apart by the leading rivet against the spring urging, and will then close together behind it under the spring urging, in the way just described. Usually the jaws move by pivoting or rocking about their rear ends, where the spring is located.

Fastener installation apparatus operating in this way has been well known for many years in the art of mechanical assembly, for installing the aforementioned blind tubular rivets available under the Registered Trade Marks CHOBERT, BRIV and AVLUG.

The head of the rivet may be of countersunk shape (i.e. for use in a countersunk hole), with a conical underhead face and a flat end face, in which case the anvil face will also be flat. Alternatively the rivet head may be of the so-called "snap-head" or domed shape, in which case the anvil face has a mating recess of complimentary shape to receive the domed head. In both cases , when the mandrel head is pulled axially through the rivet (a process referred to as broaching of the rivet, although no material should be removed from the rivet bore wall by the mandrel head), the thrust on the anvil is almost entirely in an axial direction, so that there is little or no radially outward force exerted by the rivet head on the anvil parts.

It is sometimes the case that a rivet with a countersunk head is installed in a non-countersunk hole, using a recessed anvil. When the rivet is broached, the force exerted on the rivet head by the anvil face causes the rivet head to deform so that it conforms to the shape of the anvil recess, and turns into a dome-shaped head. This requires rather more tension force to be exerted on the mandrel, but has the advantage that the resulting deformation of the rivet head, which occurs after the remote or tail end of the rivet has been deformed into engagement with the workpiece, increases the axial tension in the rivet, giving the resulting joint increased pretension, which can be desirable in certain circumstances.

One variety of blind tubular rivet which is commonly installed by such a process is that commercially obtainable under the Registered Trade Mark RIVSCREW. Such a rivet has a screw-thread formed on the exterior of its shank, which, when the rivet is broached, bites in to the material of the workpiece hole wall to become threadedly engaged with it.

The deformation of the rivet head in the countersunk-to-domehead conversion exerts a radially outward force on the recessed faces of the anvil parts. Usually the spring which urges the anvil jaws together can support this force. However, if it is necessary to provide an unusually long nosepiece (for example, in order to install rivets at the far end of a narrow but deep hole), the extended length of the nosepiece increases the moment of the radial component of the force on the anvil face, about the rear ends of the nosepiece jaws where the spring acts on them, to such an extent that the spring cannot support the moment. The result is that, when the rivet is broached, the anvil face parts do not stay closed together to confine the deforming rivet head, but open apart, thus producing faulty shaping of the rivet head, and reduced or no pretension in the resulting joint.

The apparatus provided by the present invention is intended to overcome this problem.

A different problem can occur when a rivet installation tool is mounted for predetermined positioning, e.g. on the end of a robot arm. When a tool is hand-held and is offered up to the workpiece hole by an operator (or when a tool is bench-mounted in a fixed position and the workpiece is offered up to the tool by an operator), alignment of the protruding rivet and the workpiece hole is achieved visually by the operator. However, when the positional relationship between the tool and the workpiece is predetermined (for example, by computer control of a robot arm carrying the riveting tool), accuracy of relative positioning relies upon consistent and accurate positioning of the anvil with respect to the tool body. It is possible that the two jaws, whilst still being urged into contact with each other by their spring, can together move sideways by a slight rocking movement of each jaw about its rear end. Thus the anvil can be displaced sideways from its correct position, so that the protruding rivet may not be correctly positioned in alignment with the workpiece hole in which it is intended to be installed.

The apparatus provided by a further feature of this invention is intended to overcome this second problem.

Accordingly the invention provides a nosepiece assembly for an installation tool for installing blind, pull-through, tubular rivets, which assembly comprises:

a plurality of elongated nosepiece members each having at its front end an anvil part;

resilient urging means for resiliently urging the nosepiece members towards each other, so that the anvil parts meet to form a rivet-supporting anvil for axially supporting a rivet being installed, and can be opened against the resilient urging means to allow a further rivet to be fed forwards between the separated anvil parts;

which nosepiece assembly further comprises locking means located internally of the nosepiece members for locking the anvil parts together at least when they are axially supporting a rivet being installed as aforesaid.

In one embodiment of the invention, the locking means is brought into operation to lock the anvil parts together by the rearwards axial force exerted on the anvil by the rivet being pulled against the anvil by the mandrel head.

In that case, preferably the assembly includes releasing resilient urging means for releasing the locking operation of the locking means. Preferably the assembly includes common resilient urging means for both urging the nosepiece members towards each other and for releasing the locking operation of the locking means.

In another embodiment of the invention, the assembly includes locking resilient urging means for urging the locking means into operation to lock the anvil parts together.

In that case, preferably the locking means is released, against the action of the locking resilient urging means, by the forwards axial force exerted on the anvil parts by the next rivet being fed forwardly through them. Preferably the assembly includes common resilient urging means for both urging the nosepiece members towards each other and for urging the locking means into operation.

According to a preferred feature of the invention, the locking means is provided by an inclined face on each nosepiece member, and a locking member carrying at least one inclined face, the inclined faces on the nosepiece members and the locking member being lockingly engageable with each other by relative axial movement.

Where the nosepiece members rotate about their rear ends in order to allow the anvil parts to separate as aforesaid, preferably the locking means is located axially of the nosepiece members at a position more than one third of the distance from the rear ends towards the anvil parts. It may be that the locking means is located axially of the nosepiece members at a position at least half and maybe at least two thirds, of the distance from the rear ends towards the anvil parts.

Figure 4:
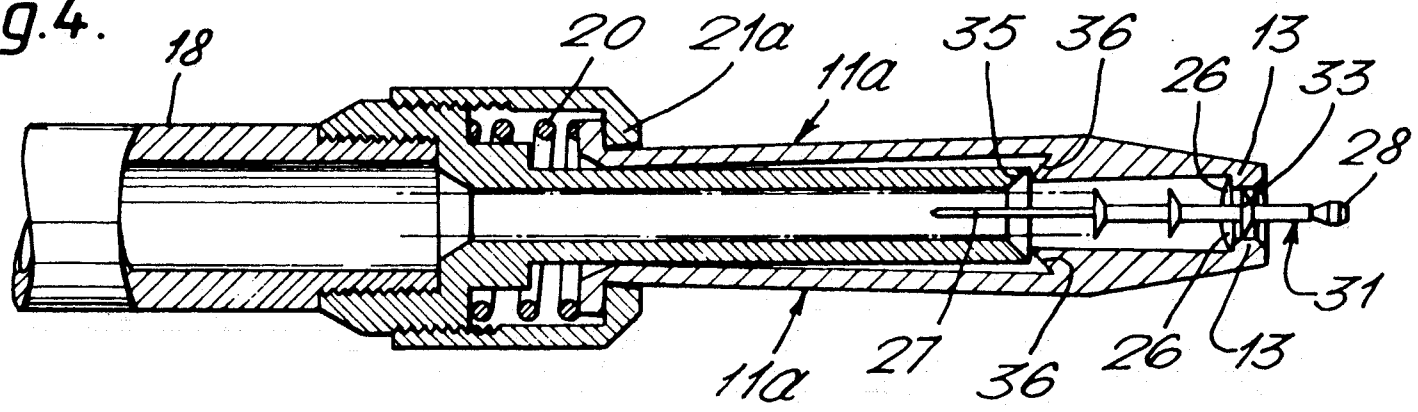
Figure 5:
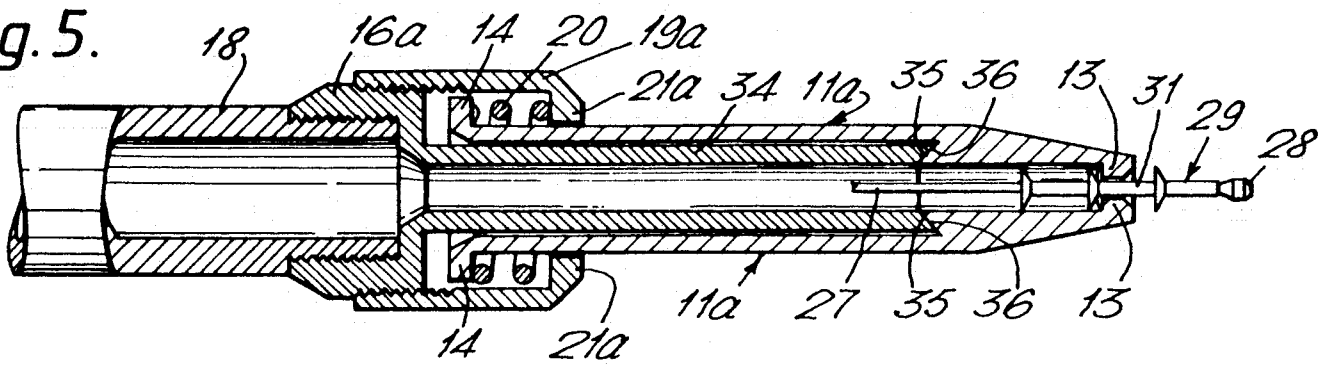
Figure 6:
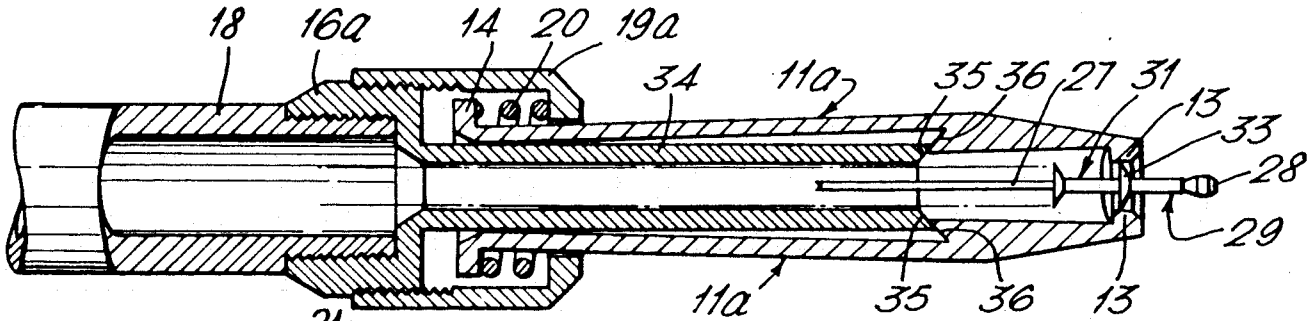
Figure 7:
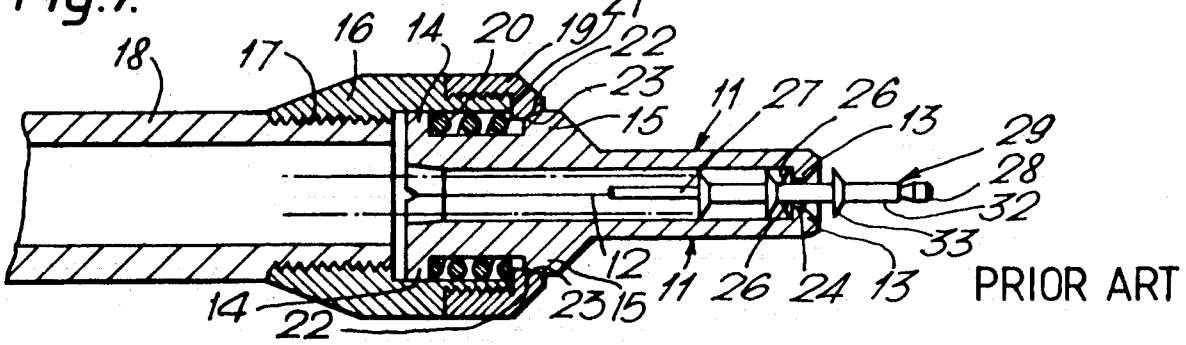

A specific embodiment of the invention, and a modification thereof, will now be described by way of example, and with the reference to the accompanying drawings, in which:

FIGS. 1 to 4 are axial sections through a nosepiece, showing various stages in its operation;

FIGS. 5 and 6 are similarly axial sections, corresponding respectively to FIGS. 1 and 4, through a modified form of nosepiece; and FIG. 7 is an axial section, corresponding to FIGS. 1 and 5, through a prior art nosepiece.

The prior art nosepiece illustrated in FIG. 7 comprises two elongated nosepiece members 11, 11, which are normally referred to in the art as jaws, as explained earlier. Each jaw is generally semi-cylindrical in form, the two jaws being mirror-images of each other about an axial plane 12 in which their flat faces meet and contact each other. Each jaw carries at its front end an anvil part 13, in the form of an inwardly directed flange. The rear end of each jaw is formed with a rear, outwardly directed flange 14, and an intermediate outwardly directed flange 15. The rear ends of the jaws are received within a generally cylindrical housing 16, the rear part of which is internally threaded at 17 and screwed on to the front end of the installation tool barrel 18. Screwed on to the front of the housing 16 is a cap 19, which at its front end has an inwardly projecting flange 21. The front of the flange 21 is formed with an internal tapering part-conical face 22, which mates with a part conical face 23 on the rear side of each jaw intermediate flange 15. A helical compression spring 20 acts between the front face of jaw rear flanges 14 and the rear face of cap flange 21, to pull the jaws rearwardly, thus wedging the part-conical jaw faces 23 into the part-conical cap face 22, and thus urging the jaws towards each other. Thus the spring 20 acts as resilient urging means to resiliently urge the jaw members together. The tapering faces 22, 23 are thus located externally of, and surrounding, the nosepiece members 11, and axially of the nosepiece members about one third of the way from their rear ends, about which they pivot to open apart, towards the anvil parts 13 at the front end.

The anvil parts 13 at the front of the jaws are formed so that, when held together in contact by the action of the spring 20, they form an annular anvil surrounding a circular aperture 24. The front of the aperture 24 is formed with a conical recessed face 25, while the rear of each anvil part is formed with a partial chamfer 26.

A rivet-installation mandrel 27 extends inside the tool barrel 18 and between the jaws 11 and through the anvil aperture 24. The forward end of the mandrel has an enlarged head 28. A column of rivets such as 29, 31 is carried on the mandrel shank, with the shank 32 of each rivet towards the mandrel head 28 and its preformed head 33 towards the rear of the mandrel. The part of the installation tool (not shown in the Figures) at the rear end of the barrel 18 includes means for reciprocating the mandrel 27 with respect to the barrel 18 and nosepiece, and means for feeding the column of rivets forwards with the mandrel as it moves forwards.

When the mandrel is drawn rearwardly, the mandrel head 28 is pulled through the protruding rivet 29 to install it, as previously described. The last part of the installation process is the deformation of the rivet head from a countersunk shape to a domehead shape, conforming to the shape of the recess defined by the faces 25. The mandrel head is pulled completely through the rivet bore and also rearwardly through the anvil aperture 24. When the mandrel and column of rivets are pushed forwards again, the head of the next rivet 31 in the column contacts the chamfer faces 26 behind the anvil parts, and pushes the jaws forwards, compressing the spring 20. This releases the wedging action of the jaw taper faces 23 in the part-conical cap face 22, and allows the anvil parts 13 to separate, each jaw pivoting or rocking about its rear end. When the rivet head has passed through the anvil aperture 24, the spring 20 urges the jaws 11, 11 rearwardly and thus together again due to the wedging action of the faces 22, 23. The anvil parts are thus urged together again, ready for the installation of the newly fed rivet.

The construction and operation of rivet installation tools, incorporating nose tips as described above, are well known in the art of blind riveting.

One embodiment of a nosepiece embodying the present invention is illustrated in FIGS. 1 to 4. Like parts to those in the prior art nosepiece of FIG. 7 are indicated by like reference numerals, with the addition of the suffix "a" if the part differs in any substantial way.

Figure 2:
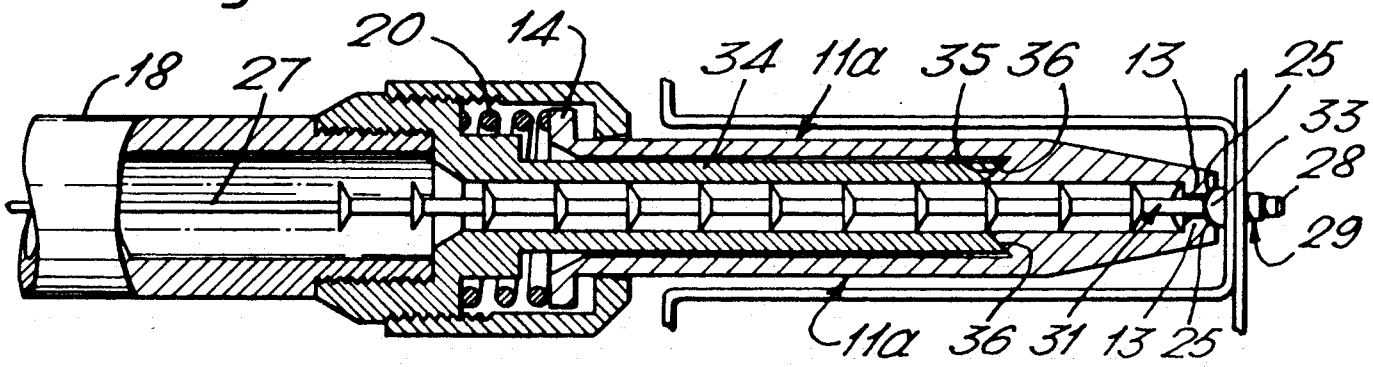

The most noticeable difference is that the nosepiece of FIGS. 1 to 4 is about twice as long as that of FIG. 7. This is necessary in order that it can install rivets in a workpiece at the bottom of a relatively deep and narrow hole, as illustrated in FIG. 2. Thus the jaws 11*a*, 11*a* in FIGS. 1 to 4 are about twice as long as the jaws 11,11 in FIG. 7. The intermediate jaw flange 15 is omitted, the rear flange 14 of each jaw being urged forwardly against the rear flange 21*a* of the cap 19*a* by the spring 20, the rear end of which acts against the front peripheral face of the housing 16*a*. Since the front of the spring 20 contacts the jaw flange 14 at its radially outer periphery, it urges the jaws towards each other in a radial direction. This will be clear from a consideration of the fact that an attempt to pull the jaws apart will result in each of them pivoting about its rear end, where each jaw is confined by the cap flange 21. This will result in the jaw flange 14 pivoting backwards, thus compressing the spring 20.

The housing 16*a*, which is securely screwed on to the front of the tool barrel 18, is extended forwardly, inside the jaws 11*a*, in the form of a tube 34, through which the mandrel 27 and column of rivets extend. In practice, the external diameter of the tube 34 is such that, when the jaws 11*a* are closed together in contact with each other, the inner part-cylindrical face of each jaw is also in contact (or very nearly so) with the exterior of the tube 34. However, in the accompanying Figures a small gap between them is shown, only for the purpose of clarity of illustration.

Locking means for locking the anvil parts together (at least when they are axially supporting a rivet being installed) is located internally of the nosepiece members, and at an axial position along the nosepiece members rather more than two thirds of the way from the rear flanges 14 to the anvil parts 13. It comprises an inclined face in the form of a frusto-conical locking taper face 35 on the front end of the tube 34, together with an inclined face in the form of a half frusto-conical taper face 36 on the inside of the forward end of each jaw 11*a*. The frusto-conical faces have their wider ends towards the forward or anvil end of the nosepiece, and their narrower ends towards the rear end, and their taper angles are the same. In this example the included angle of the frusto conical faces is 90 degrees. As shown in FIG. 1, when the jaws are in their forwardmost position with the rear flanges 14 in contact with the cap flange 21*a* under the urging of spring 20, the faces 36 on the nosepiece are spaced forwardly of the fixed locking face 35. Their relative position is such that the rearmost edge of the nosepiece faces 36 is just behind the front edge of the fixed face 35. Thus if an attempt is made to force the jaws 11*a* apart, the extent to which they can move apart is limited by the engagement of the rearmost part of nosepiece faces 36 with the front part of the fixed face 35.

When the rivet 29 in front of the anvil has been inserted into the workpiece hole and the installation tool is operated to retract the mandrel 27, the rivet is pulled back against the anvil. This retraction force is sufficiently strong to overcome the urging of the spring 20, and move the jaws 11*a* rearwardly with respect to the barrel, which is pulled forwardly by the action of the tool to keep the anvil pressed against the rivet head. The nosepiece taper faces 36 enter the fixed taper face 35 until they are in contact. This happens before any substantial deformation of the rivet head 33 occurs which would exert any substantial force radially outwardly on the anvil faces. The wedging action of the taper faces being urged into the mutual contact locks the nosepiece jaws together. FIG. 2 illustrates the position towards the end of the rivet deformation process, when the rivet head 33 is being deformed from a countersunk to a domehead shape. The material of the rivet head exerts a radially outwards force on the part-conical anvil faces 25 in the anvil recess, but these faces are prevented from separating from each other by the locking action of the tapered faces 35, 36. The wedging action of these locking faces ensures that the greater the axial force, and therefore the greater the radially outward force, exerted on the anvil by the rivet, the greater the locking force.

Figure 3:
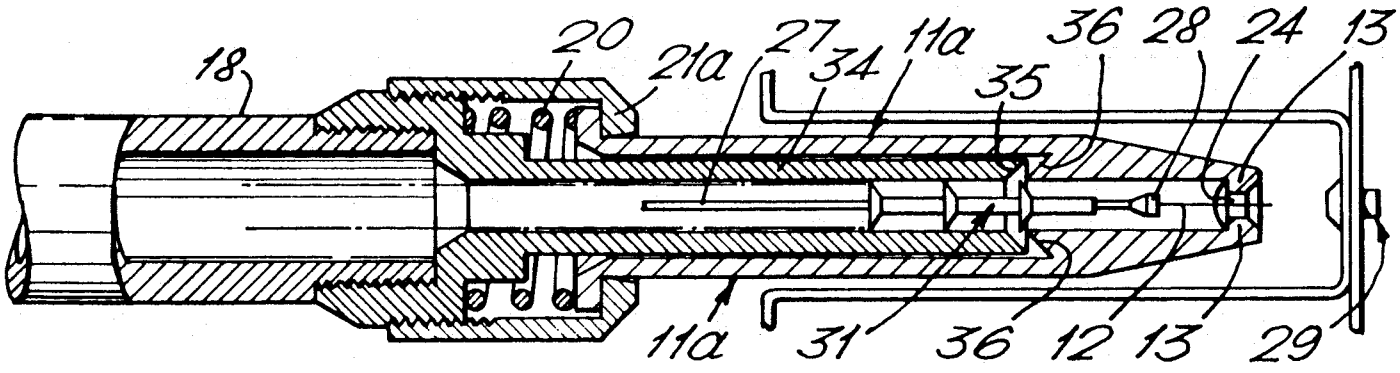

Continued retraction of the mandrel 27 withdraws the mandrel head completely from the installed rivet 29, as shown in FIG. 3. As soon as the mandrel head 28 is free from the rivet head the rearward force by the rivet on the anvil is removed, and the spring 20 urges the jaws forwards again, thus releasing the locking action of the tapered faces 35, 36. The mandrel is then in its fully retracted position as illustrated in FIG. 3.

The column of rivets is then urged forwardly so that the next rivet 31 contacts the rear of the mandrel head 28. The mandrel and column of rivets are fed forwards together, and the head of the rivet 31 pushes the anvil parts 13, 13 apart so that it can pass forwardly between them, as illustrated in FIG. 4. Each jaw rotates or pivots about its rear end, against the urging of spring 20. The jaws 11*a*, 11*a* then close behind the rivet, ready to install it, so that the position is again as illustrated in FIG. 1.

Thus, in the embodiment of FIGS. 1 to 4, the locking means to lock the anvil parts together is brought into operation by the rearwards axial force exerted on the anvil by the rivet being installed, and the spring 20 provides common resilient urging means for both urging the nosepiece members towards each other and for releasing the locking operation of the locking means.

The embodiment illustrated in FIGS. 5 and 6 is a modification of that illustrated in FIGS. 1 to 4. The construction is generally similar, except that the spring 20 is positioned in front of the jaw rear flanges 14, and between them and the cap flange 21*a*. Thus the spring 20 urges the jaws 11*a*, 11*a* rearwardly, and thus urges the locking taper faces 35, 36 into locking engagement, as illustrated in FIG. 5. Thus the jaws are normally locked together, and the locking force due to the spring 20 is increased when the rivet is being installed, by the addition of the rearwards axial force on the anvil due to the rivet. When, after the installation of a rivet, the mandrel and rivet column are fed forwards, the head of the leading rivet contacts the rear of the anvil parts and pushes the jaws forwards. This allows the taper locking faces 35, 36 to partially disengage, sufficiently to allow the anvil parts to separate enough to allow the rivet head 33 to pass between them, as illustrated in FIG. 6. At this maximum separation of the anvil parts, the rear parts of the taper locking faces 36 on the jaws are still in contact with the forward part of the fixed locking taper face 35 on the tube 34.

Thus, in the embodiment illustrated in FIGS. 5 and 6, the spring 20 provides common resilient urging means for both urging the nosepiece members towards each other and for urging the locking means into operation, and the locking means is released, against the action of the resilient urging means, by the forwards axial force exerted on the anvil parts by the next rivet being fed forwardly through them.

The location of the locking means 35, 36 internally of the nosepiece members 11*a*, 11*a* enables the locking means to be positioned, axially of the nosepiece members, substantially closer to the anvil than to the rear ends of the nosepiece members, about which rear ends the nosepiece members pivot to open the anvil parts apart. Hence the moment (i.e. force multiplied by its distance from the pivot position) exerted by the locking means to oppose separation of the anvil parts, in relation to the moment exerted by radial forces on the anvil parts from the rivet head during its deformation, is relatively much greater than in the prior art nosepiece assembly illustrated in FIG. 7, in which the locking means is much nearer the rear ends of the nosepiece members.

Since, in the embodiments of both FIGS. 1 to 4 and FIGS. 5 and 6, when the nosepiece members are locked together by the tapered face locking means, each of them is also locked against the outer surface of the tube 34 (as explained previously, the gap shown in FIGS. 1 to 6 is only for the purpose of clarity of illustration), the tube 34, which is located in a fixed position on the tool barrel 18, also provides locating means for fixedly locating the nosepiece members with respect to the tool body, at least when the nosepiece members are locked together. In the embodiment of FIGS. 5 and 6 the nosepiece members are thus fixedly located at all times except when a rivet is being fed forwardly through the anvil. In the arrangement shown in FIGS. 1 to 4, this location of the nosepiece members requires the mandrel to be retracted sufficiently to bring the locking faces into full engagement, before inserting the protruding rivet into the workpiece hole. This also ensures that the rivet is urged into contact with the anvil, thereby locating the rivet with respect to the anvil and thus with respect to the tool body.

The invention is not restricted to the details of the foregoing examples.

We claim:

1. A nosepiece assembly for an installation tool for installing blind, pull-through, tubular rivets, which assembly comprises:

a plurality of elongated nosepiece members each having a front end with an anvil part and a rear end;

resilient urging means for resiliently urging the nosepiece members towards each other, so that the anvil parts meet to form a rivet-supporting anvil for axially supporting a rivet being installed, and openable against the resilient urging means to allow a further rivet to be fed forwards between the opened anvil parts;

which nosepiece assembly further comprises locking means located internally of the nosepiece members for locking the anvil parts together at least when the anvil parts are axially supporting a rivet being installed, wherein the nosepiece members rotate about their rear ends in order to allow the anvil parts to separate, and wherein the locking means are located axially of the nosepiece members at a position intermediate the rear ends and the anvil parts.

2. A nosepiece assembly as claimed in claim 1, in which the locking means is brought into operation to lock the anvil parts together by a rearwards axial force exerted on the anvil parts by the rivet being pulled against the anvil parts by a mandrel head.

3. A nosepiece assembly as claimed in claim 1 or claim 2, including releasing resilient urging means for releasing the locking operation of the locking means.

4. A nosepiece assembly as claimed in claim 3, wherein the means for both urging the nosepiece members towards each other and the means for releasing the locking operation of the locking means are comprised by a common resilient urging means.

5. A nosepiece assembly as claimed in claim 1, including locking resilient urging means for urging the locking means into operation to lock the anvil parts together.

6. A nosepiece assembly as claimed in claim 5, in which the locking means is released, against the action of the locking resilient urging means, by a forwards axial force exerted on the anvil parts by a next rivet being fed forwardly through them.

7. A nosepiece assembly as claimed in claim 5 or claim 6, wherein the means for both urging the nosepiece members towards each other and the means for urging the locking means into operation are comprised by a common resilient urging means.

8. A nosepiece assembly as claimed in claim 1, in which the locking means is provided by an inclined face on each nosepiece member, and a locking member carrying at least one inclined face, the inclined faces on the nosepiece members and the locking member being lockingly engageable with each other by relative axial movement.

9. A nosepiece assembly as claimed in claim 8, including locating means connectable to the installation tool for fixedly locating the nosepiece members with respect to the tool at least when the nosepiece members are locked to the locking member.

10. A nosepiece assembly as claimed in claim 9, in which the locking member is carried by the locating means.

11. A nosepiece assembly as claimed in claim 1, in which the locking means is located axially of the nosepiece members at a position at least half of the distance from the rear ends towards the anvil parts.

12. A nosepiece as claimed in claim 1, in which the locking means is located axially of the nosepiece members at a position at least two thirds of the distance from the rear ends towards the anvil parts.

* * * * *